US007676324B2

(12) United States Patent
Bae

(10) Patent No.: US 7,676,324 B2
(45) Date of Patent: Mar. 9, 2010

(54) ALERTING A VEHICLE OPERATOR TO TRAFFIC MOVEMENT

(75) Inventor: Hong S. Bae, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 916 days.

(21) Appl. No.: 11/440,577

(22) Filed: May 25, 2006

(65) Prior Publication Data

US 2007/0276581 A1 Nov. 29, 2007

(51) Int. Cl.
*G08G 1/09* (2006.01)

(52) U.S. Cl. ..... 701/117; 340/901

(58) Field of Classification Search ..... 701/117, 701/300, 213; 340/901, 903, 435, 439, 988, 340/995, 990, 576
See application file for complete search history.

(56) References Cited

U.S. PATENT DOCUMENTS

| | | | | |
|---|---|---|---|---|
| 4,349,823 | A | 9/1982 | Tagami et al. | 343/7 |
| 4,543,577 | A | 9/1985 | Tachibana et al. | 340/904 |
| 5,091,726 | A | 2/1992 | Shyu | 340/904 |
| 5,805,103 | A | 9/1998 | Doi et al. | 342/70 |
| 6,502,035 | B2 | 12/2002 | Levine | 701/301 |
| 6,636,149 | B2 * | 10/2003 | Moon | 340/439 |
| 6,838,981 | B2 * | 1/2005 | Zoratti | 340/435 |
| 6,977,609 | B2 | 12/2005 | Pleva et al. | 342/28 |
| 2003/0030554 | A1 | 2/2003 | Yavitz | 340/466 |
| 2005/0137783 | A1 * | 6/2005 | Dort | 701/119 |
| 2005/0280519 | A1 | 12/2005 | Nagata | 340/435 |

* cited by examiner

*Primary Examiner*—Dalena Tran
(74) *Attorney, Agent, or Firm*—Cantor Colburn LLP

(57) ABSTRACT

Methods, systems and computer program products for alerting a vehicle operator to traffic movement. The methods include identifying a zone around a host vehicle and identifying a target vehicle in the zone. The speed and location of the target vehicle are monitored. An alert is generated in the host vehicle if the target vehicle is moving outside of the zone at a speed higher than a minimum speed and the host vehicle is stationary.

20 Claims, 4 Drawing Sheets

ALERTING A VEHICLE OPERATOR TO TRAFFIC MOVEMENT

BACKGROUND OF THE INVENTION

The present disclosure relates generally to alerting a vehicle operator to traffic movement, and more particularly, to detecting the presence of a preceding vehicle and alerting the vehicle operator when the preceding vehicle moves forward or departs the current lane.

When a vehicle that is traveling in a series of consecutive vehicles stops due to traffic lights or a traffic jam, the operator often fails to move the vehicle forward immediately (or within a short period of time) after the traffic light changes or the traffic jam is cleared. This failure to move the vehicle forward may cause further delays or traffic jams to occur.

Sensors (e.g., radar systems) have been developed for various applications associated with vehicles, such as automobiles and boats. A sensor mounted on a vehicle detects the presence of objects including other vehicles in proximity to the vehicle. In an automotive application, sensors can be used in conjunction with the braking system to provide active collision avoidance and/or in conjunction with an adaptive cruise control (ACC) system to provide speed and traffic spacing control. In a further automotive application, sensors provide a passive indication of obstacles to the driver on a display. The sensors may also be used in conjunction with vision cameras to provide further information about nearby objects or obstacles.

It would be desirable to have a mechanism for reminding the operator of a vehicle to move the vehicle forward immediately or shortly after a traffic light has changed or a traffic jam has been cleared. In addition, it would be desirable for the mechanism to utilize any existing sensors, vision cameras and human machine interfaces (dashboard, microphone) already located on the vehicle for detecting traffic movement and for alerting the operator of the vehicle that it is time to move the vehicle forward.

BRIEF DESCRIPTION OF THE INVENTION

Embodiments include a method for alerting a vehicle operator to traffic movement. The method includes identifying a zone around a host vehicle and identifying a target vehicle in the zone. The speed and location of the target vehicle are monitored. An alert is generated in the host vehicle if the target vehicle is moving outside of the zone at a speed higher than a minimum speed and the host vehicle is stationary.

Embodiments also include a system for alerting a vehicle operator to traffic movement. The system includes an object detection device and a processor in communication with the object detection device. The processor includes instructions for facilitating identifying a zone around a host vehicle. A target vehicle is identified in the zone using input from the object detection device. The speed and location of the target vehicle is monitored using input from the object detection device. An alert is generated in the host vehicle if the target vehicle is moving outside of the zone at a speed higher than a minimum speed and the host vehicle is stationary.

Further embodiments include a computer program product for alerting a vehicle operator to traffic movement. The computer program product includes a storage medium readable by a processing circuit and storing instructions for execution by the processing circuit for performing a method. The method includes identifying a zone around a host vehicle and identifying a target vehicle in the zone. The speed and location of the target vehicle are monitored. An alert is generated in the host vehicle if the target vehicle is moving outside of the zone at a speed higher than a minimum speed and the host vehicle is stationary.

BRIEF DESCRIPTION OF THE DRAWINGS

Referring now to the figures, which are meant to be exemplary embodiments, and wherein the like elements are numbered alike.

DETAILED DESCRIPTION OF THE INVENTION

Exemplary embodiments detect the presence of a preceding vehicle and estimate the intention of the preceding vehicle. When the preceding vehicle moves forward or departs the current lane, exemplary embodiments alert the driver in the host vehicle, prompting an action from the driver. Exemplary embodiments are referred to herein as the "go-notifier."

In exemplary embodiments, the go-notifier is a driver convenience feature that helps the driver when stopped at a traffic light or in stop-and-go traffic. When stopped at a traffic light or in a traffic jam, the driver may be distracted (e.g., talking to children in the back seat or changing music on a vehicle audio system) and hence not paying attention to the traffic ahead. If the vehicle in front has started moving again and the driver does not take an appropriate action within a short period of time, the go-notifier prompts the driver through notifications via visual, aural and/or haptic (e.g., vibrating seat) human machine interfaces (HMIs). In order to maximize the convenience potential, the go-notifier may function independently of driving modes (e.g., the go-notifier can be made available only in automated driving such as adapted cruise control or it could be made available in manual driving as well).

Figure 1:
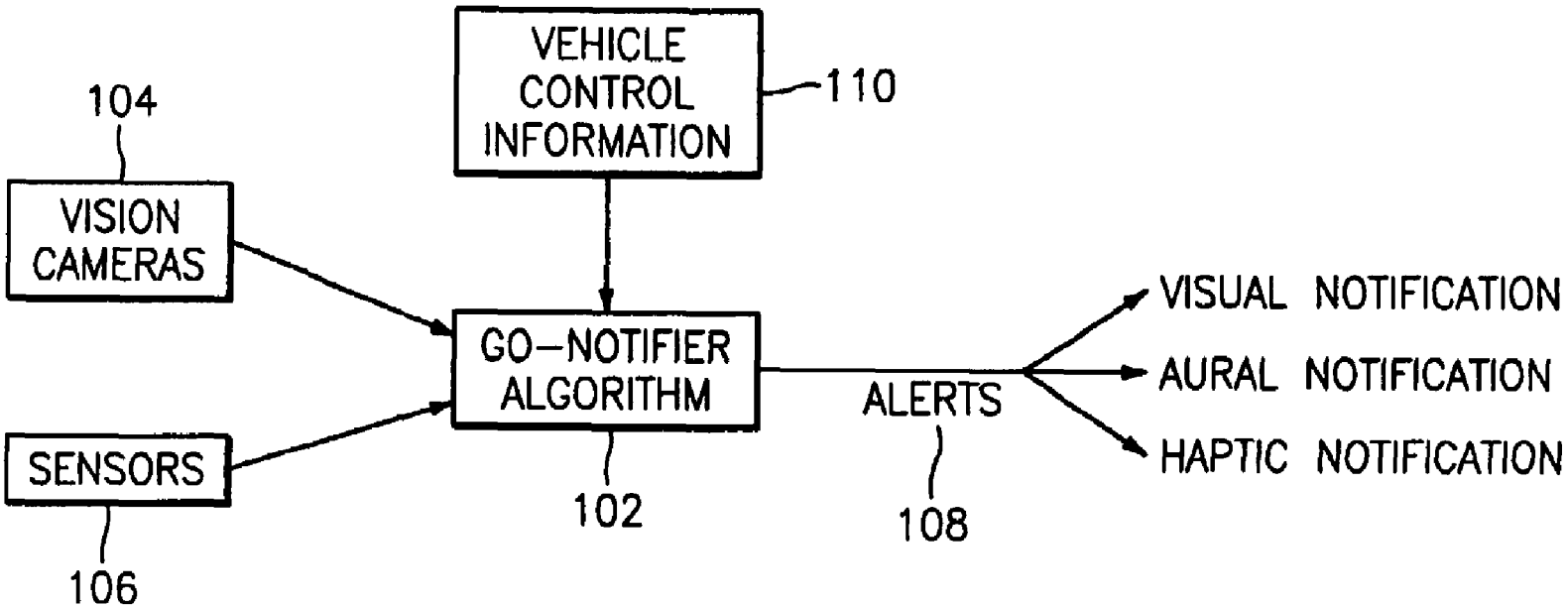
FIG. 1 is a block diagram of a system that may be implemented by exemplary embodiments.

FIG. 1 is a block diagram of a system that may be implemented by exemplary embodiments. The system depicted in FIG. 1 includes a go-notifier algorithm 102 for implementing the go-notifier functions described herein. The system depicted in FIG. 1 also includes a vision camera(s) 104, a sensor(s) 106, vehicle control information 110 for providing input to the go-notifier algorithm 102, and an alert(s) 108 that is output from the go-notifier algorithm 102. The vision camera(s) 104 and sensor(s) 106 are examples of object detection devices that may be utilized. Other object detection devices may also be utilized to implement the functions described herein.

The object detection device(s) is utilized to detect the presence of a target vehicle, as well as the speed and location of the target vehicle. Information about the presence, speed and location of the target vehicle from the object detection device (s) is input to the go-notifier algorithm 102. The input may be requested by the go-notifier algorithm 102 ("pulled") or sent to the go-notifier algorithm 102 on a periodic basis ("pushed"). Additional input to the go-notifier algorithm may include the vehicle control information 110. Input to the go-notifier algorithm 102 may be made in a wired and/or wireless fashion. The alert 108 generated by the go-notifier algorithm 102 may be transmitted to a HMI(s) on the host vehicle to cause one or more visual, aural and haptic notifications to an occupant of the host vehicle. These alerts 108 may be transmitted in a wired and/or wireless fashion.

The go-notifier algorithm 102 is implemented by software instructions or hardware instructions or by a combination of both software and hardware instructions. In exemplary embodiments, the go-notifier algorithm 102 is implemented by a processor located in the host vehicle. In alternate exemplary embodiments, the go-notifier algorithm 102 is implemented by a processor located remotely from the host vehicle (e.g., at an OnStar® site) with wireless communication to the host vehicle for receiving input from the vehicle control information 110 and one or both of the vision camera(s) 104 and the sensor(s) 106, and for outputting alerts 108.

The sensors 106 are utilized to determine: that a target vehicle is within a pre-defined zone around the host vehicle; a distance between the host vehicle and the target vehicle; and also a speed of the target vehicle (may be calculated based on the distance between the host and target vehicles over time). Any sensors 106 (e.g., short range radar, long range radar, infrared and ultrasonic) for detecting a distance between the host vehicle and the target vehicle may be utilized by exemplary embodiments. Exemplary embodiments utilize sensors 106 already located on the target vehicle for other functions. For example a forward looking long range sensor 106 provided with adaptive cruise control (ACC) may be utilized by the go-notifier algorithm 102 for sensing and/or detection of objects in front of the host vehicle. The long range sensor 106 provided with ACC may be utilized to provide both the distance to the target vehicle and the velocity of the target vehicle to the go-notifier algorithm 102. In alternate embodiments, the sensors 106 are utilized solely by the go-notifier algorithm 102 and are installed in the host vehicle as part of the go-notifier installation process.

The vision camera(s) 104 may be utilized to detect sideways movement/motion relative to the host vehicle. Any vision camera(s) 104 for detecting movement on the sides of the host vehicle may be utilized by exemplary embodiments. Exemplary embodiments utilize vision cameras 104 already located on the target vehicle for other functions. For example, the vision camera(s) 104 provided with a parking assist function may utilized by the go-notifier algorithm 102 for detecting movement on the sides of the host vehicle. In alternate embodiments, the vision cameras 104 are utilized solely by the go-notifier algorithm 102 and are installed in the host vehicle as part of the go-notifier installation process.

The vehicle control information 110 includes data about the host vehicle such as host vehicle speed, host vehicle acceleration, host vehicle brake status, host vehicle accelerator percent (or override) and transmission gear. The vehicle control information 110 is input to the go-notifier algorithm 102 for determining when to issue an alert 108. All, a subset, or a different set of data than that listed above may make up the vehicle control information 110 in alternate exemplary embodiments. The vehicle control information 110 is received from processors on the host vehicle that track and/or calculate the data for use by other functions in the host vehicle. In alternate exemplary embodiments, one or more of the data that make up the vehicle control information 110 are utilized solely by the go-notifier algorithm 102.

As depicted in FIG. 1, the go-notifier algorithm 102 outputs an alert 108 when the go-notifier algorithm 102 determines that the host vehicle driver should be reminded to move forward. The alert(s) 108 may be translated into one or more visual, aural and haptic notifications to the driver of the host vehicle. In exemplary embodiments, the notifications are made by one or more HMIs located on the host vehicle. In exemplary embodiments, a visual notification includes having a message appear on the dashboard (in a noticeable color, blinking, etc.) of the host vehicle. In this case, the alert 108 sends a message to the dashboard display panel instructions to request that a message be displayed (e.g., particular letters/numbers, at a particular location and in a particular color). In exemplary embodiments, the message (or flashing telltale symbol) may be displayed on any surface in the car that can be seen by the driver of the host vehicle (e.g., rear view mirror or steering wheel).

In exemplary embodiments, an aural notification includes any sound, such as a chime or beep, to get the attention of the driver of the vehicle. Alternatively, an aural notification may include a verbal message such as "car ahead is moving" or "traffic clear, please move forward carefully." A haptic notification refers to a vibration or other movement intended to get the attention of the driver of the vehicle. For example, the driver seat (or steering wheel) may vibrate in response to receiving an alert 108. Other haptic alerts 108 may include vibrating pedals (e.g., brake and/or gas). Any combination of notifications may be implemented and notifications that are already in use to perform other function on the host vehicle may be utilized with or without slight modifications (e.g., use the display panel but have it display a go-notifier message). In addition, existing speakers, displays and/or haptic mechanisms utilized to perform other functions may be utilized by the go-notifier.

In exemplary embodiments, an alert 108 from the go-notifier algorithm 102 causes a green "vehicle ahead" telltale to be flashed on the dashboard (e.g., the same telltale utilized by an existing ACC system), together with either audible beeps (e.g., five beeps at 2,000 Hertz with a 200 millisecond cadence) or a vibrating driver seat (e.g., 3 vibrating seat pulses on the front of the seat at a cadence of 200 milliseconds) if the directionally vibrating seat is available and selected as the main alerting device. The previous example is intended to be exemplary in nature as other combinations of notifications may be implemented depending on user preferences and features (e.g., on speakers, displays, and driver seat) available in the host vehicle. Further, the combination of notifications may vary based on other factors such as the current driver mode of the host vehicle, weather conditions, etc.

Figure 2:
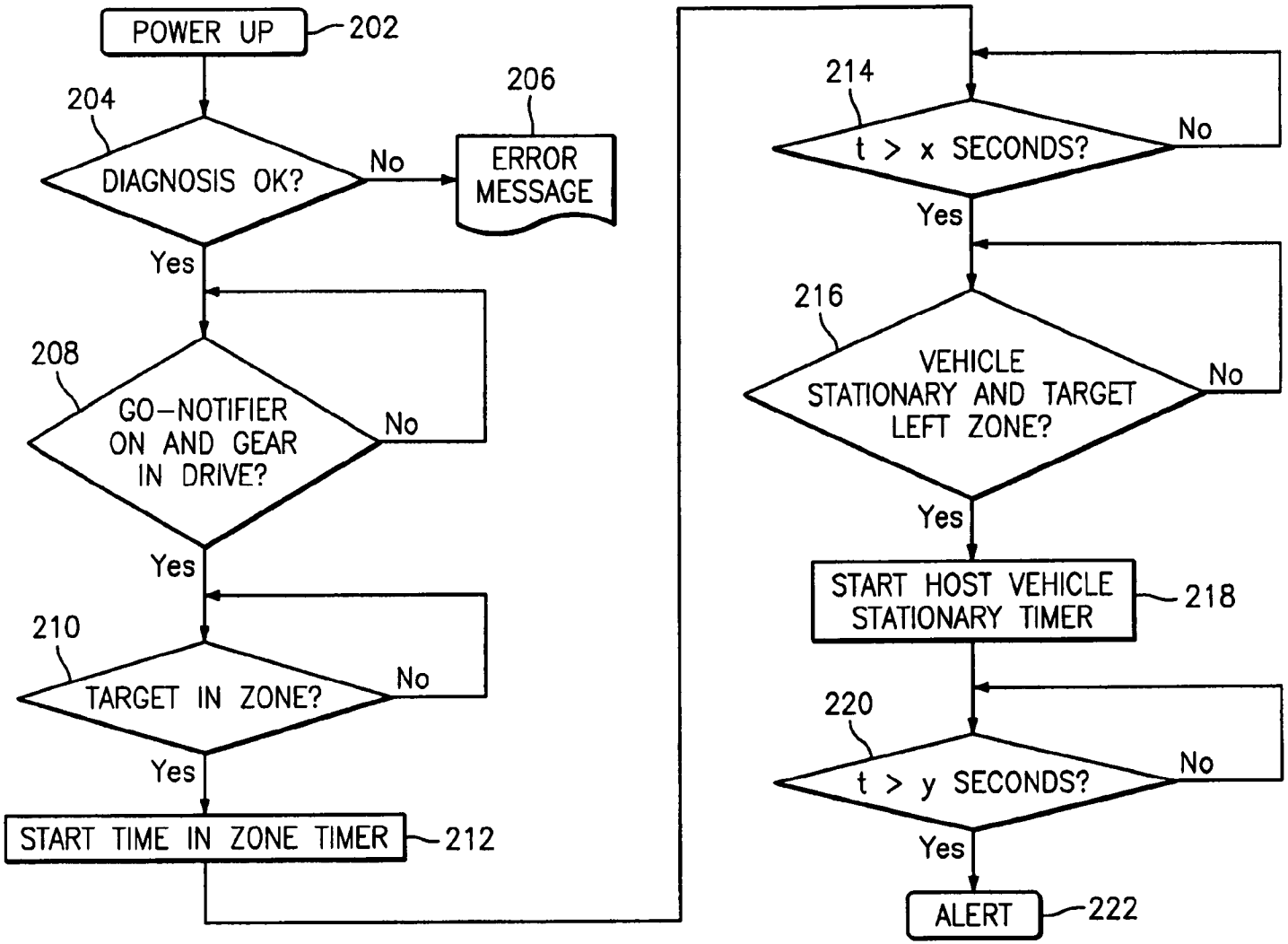
FIG. 2 is an overview of a process flow that may be implemented by exemplary embodiments of the present invention.

FIG. 2 is an overview of a go-notifier algorithm 102 process flow that may be implemented by exemplary embodiments of the present invention. The process starts at block 202 when the host vehicle engine is started. At block 204, a check is made to determine if the sensors 106, vision camera 104, and vehicle control information 110 are working properly. In addition, at block 204, a check is made to determine if the HMIs utilized by the go-notifier algorithm 102 to notify the driver are working properly. This includes one or more of the visual notification, aural notification and haptic notification (actual notifications depend on specific notifications utilized by the host vehicle) generated in response to receiving an alert 108. Block 206 is performed to generate an error message if any errors are found at block 204.

At block 208 in FIG. 2, a check is made to determine if the go-notifier is activated and if the host vehicle is in the drive gear (or any other forward gear). In exemplary embodiments, the information about what gear the host vehicle is currently in is received by the go-notifier algorithm 102 from the vehicle control information 110. If the go-notifier is not activated and/or the host vehicle is not in the drive gear (or any other forward gear), then processing continues with a loop back up to block 208 to continue checking. If the go-notifier is activated and the host vehicle is in the drive gear (or any other forward moving gear), then block 210 is performed to determine if a target vehicle is within a zone (relative to the host vehicle). The zone is a predefined space in front of the host vehicle and exemplary zones are described further below in reference to FIG. 3. The presence of a target vehicle is detected using the sensors 106 (or other object detection devices). If a target vehicle is not in the zone, then processing continues with a loop back up to block 210 to continue checking for a target vehicle in the zone.

If a target vehicle is in the zone, then block 212 in FIG. 2 is performed and a time in zone timer is started to time how long the target vehicle is in the zone. At block 214, it is determined if the time in zone timer indicates more than a pre-defined time in zone threshold (e.g., 2 seconds, 10 seconds, 20 seconds). If the time in zone timer indicates more than the pre-defined time in zone threshold, then processing continues with a loop back up to block 214 to continue counting the time the target vehicle spends in the zone by incrementing the time in zone timer. The pre-defined time in zone threshold may be adjusted based on user requirements and/or road or traffic/weather conditions. The adjustment may occur dynamically based on current road or traffic/weather conditions and/or initialized by the operator of the vehicle. Checking that the target vehicle is in the zone for a pre-defined length of time is utilized by exemplary embodiments to prevent the generation of false alerts 108 for fly-by and diagonal crossing scenarios such as the ones depicted in FIGS. 5 and 6.

If it is determined that the time in zone timer indicates more than the pre-defined time in zone threshold, then block 216 is performed. At block 216, it is determined if the host vehicle is stationary and if the target vehicle has left the zone. If the host vehicle is not stationary and/or the target vehicle has not left the zone, then processing loops back to block 216 to check again. If the host vehicle is stationary and the target vehicle has left the zone, then block 218 is performed to start a host vehicle stationary timer to time how long the host vehicle is stationary after the target vehicle moves out of the zone. The term "minimum speed" refers to a threshold that the speed of the target vehicle must meet as it is moving out of the zone in order for an alert to be generated. The speed of the target vehicle is used, first, to verify that the target vehicle is indeed moving forward and that it continues moving forward beyond the predefined zone, and second, to vary the pre-defined time thresholds (e.g., host vehicle stationary threshold and time in zone threshold) based on the target vehicle speed.

At block 220, it is determined if the host vehicle stationary timer indicates more than a pre-defined host vehicle stationary threshold (e.g., 2 seconds, 10 seconds, 20 seconds). If the stationary timer does not indicate more than the pre-defined host vehicle stationary threshold, then processing continues with a loop back up to block 220 to continue counting the time the host vehicle is stationary by incrementing the host vehicle stationary timer. The pre-defined host vehicle stationary threshold may be adjusted based on user requirements and/or road or traffic/weather conditions. These pre-defined time thresholds may also vary based on the target vehicle speed. For example, the host vehicle stationary threshold may be two seconds when the target vehicle is detected to be moving at five miles per hour; and the host vehicle stationary threshold may be a half a second when the target vehicle is detected to be moving at twenty miles per hour. The adjustment may occur dynamically based on current road or traffic/weather conditions and/or initialized by the operator of the vehicle.

If the stationary timer indicates that the host vehicle has been stationary for the pre-defined host vehicle stationary threshold, then block 222 is performed and an alert 108 is issued. Checking that the host vehicle is stationary for a pre-defined length of time is utilized by exemplary embodiments to allow the driver of the vehicle a pre-defined length of time to react to the movement of the target vehicle.

Figure 3:
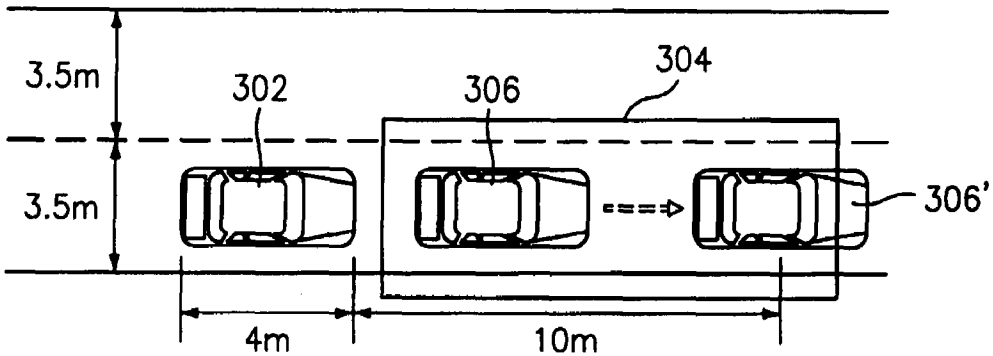
FIG. 3 is a diagram of a target vehicle moving out of zone scenario that may be implemented by exemplary embodiments.

FIG. 3 is a diagram of a target vehicle moving out of zone scenario that may be implemented by exemplary embodiments. FIG. 3 depicts a host vehicle 302 and a target vehicle 306 that is within a predefined zone 304 relative to the host vehicle 302. Exemplary embodiments, such as the one depicted in FIG. 3 define the zone 304 as a rectangular space directly in front of the host vehicle 302. The zone 304 depicted in FIG. 3 is a four meter wide space that starts immediately at the front of the host vehicle 202 and continues out for ten meters. Because the zone 304 is defined in relation to the host vehicle 302, the zone 304 changes as the host vehicle 302 moves. The zone 304 depicted in FIG. 3 is intended to be exemplary in nature and other zones 304 may be implemented by exemplary embodiments. For example, the zone 304 may be more or less than four meters wide (adjustable from vehicle to vehicle or dynamically within a vehicle based on factors such as the width of the target vehicle 306 and/or width of the road lanes) and the length of the zone 304 may be more or less than ten meters long (adjustable from vehicle to vehicle or dynamically within a vehicle based on factors such as length of the target vehicle 306 and/or traffic congestion/road conditions/weather conditions). The zone 304 does not have to be rectangular in shape and in alternate exemplary embodiments, the zone 304 is a different shape such as a square or an oval.

In exemplary embodiments, the go-notifier algorithm 102, such as the one depicted in FIG. 2, defines the boundaries of a zone 304 associated with the host vehicle 302. The go-notifier algorithm 102 then determines (e.g., using sensors 106) if a target vehicle 306 is within the zone 304. If the target vehicle 306 is in the zone 304 for the amount of time specified by the pre-defined time in zone threshold, then the target vehicle 306 is assumed to be located ahead of the host vehicle 302 in a stream of traffic (the stream may include only the target vehicle 306 and the host vehicle 302). As depicted in FIG. 3, if the target vehicle 306 is in the zone 304 for the pre-defined length of time in zone threshold and then the target vehicle 306' moves out of the zone 304 and continues to move forward (to avoid false alarms when the target vehicle 306 moves forward a few feet and then stops), the driver of the host vehicle 302 is given pre-defined amount of time to react to the movement of the target vehicle 306. This amount of time is referred to as the host vehicle stationary threshold as measured by the host vehicle stationary timer. The host vehicle stationary threshold can be programably updated based on variables such as user requirements, road conditions and/or traffic/weather conditions.

If the go-notifier algorithm 102 does not detect that the host vehicle 302 is moving forward within the amount of time specified by the stationary threshold, then an alert 108 is generated to notify the driver of the host vehicle 302 that it may be time to move the host vehicle 302 forward. As described previously, the notification may take the form of one or more visual, aural and/or haptic notifications directed to the driver of the host vehicle 302. In reference to FIG. 3, when the host vehicle 302 is stationary, the target vehicle 306' is moving at a pre-defined minimum speed (e.g., 1 kilometer per hour, 5 kilometers per hour) and the target vehicle 306' starts to move out of the zone 304, then an alert 102 is generated.

Figure 4:
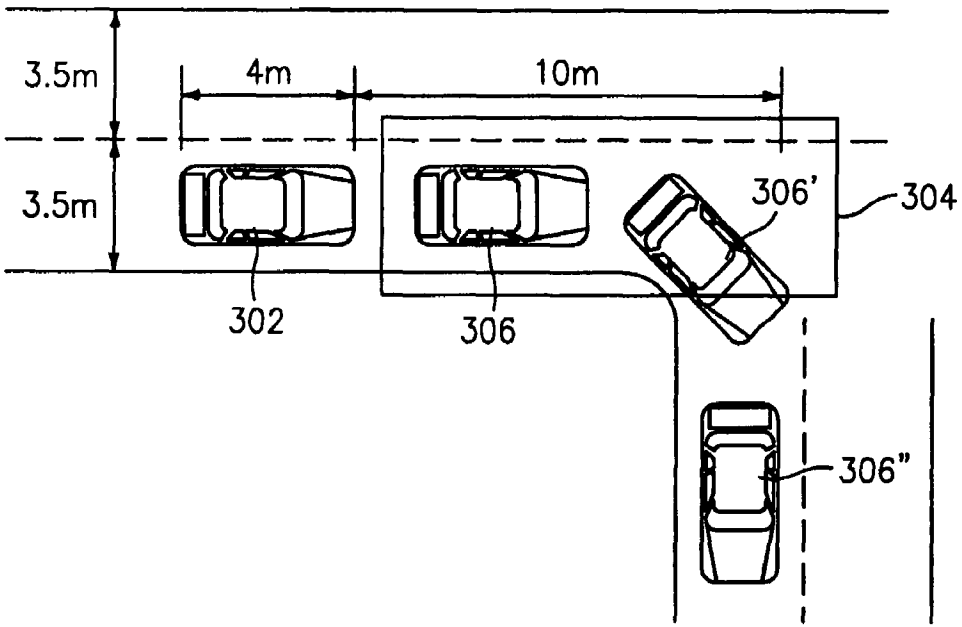
FIG. 4 is a diagram of a target vehicle turning scenario that may be implemented by exemplary embodiments.

FIG. 4 is a diagram of a target vehicle turning scenario that may be implemented by exemplary embodiments. FIG. 4 depicts a host vehicle 302 and a target vehicle 306 that is within a predefined zone 304 relative to the host vehicle 302. The go-notifier algorithm 102 determines (e.g., using sensors 106) that the target vehicle 306 is within the zone 304. If the target vehicle 306 is in the zone 304 for the amount of time specified by the pre-defined time in zone threshold, then the target vehicle 306 is assumed to be located ahead of the host vehicle 302 in a stream of traffic (the stream may include only the target vehicle 306 and the host vehicle 302). As depicted in FIG. 4, if the target vehicle 306 is in the zone 304 for the pre-defined length of time in zone threshold and then the target vehicle 306" moves out of the zone 304 by turning right (or left) out of the zone 304, the driver of the host vehicle 302 is given a pre-defined amount of time (referred to herein as the host vehicle stationary threshold) to react to the movement of the target vehicle 306. The host vehicle 302 may use sensors 106 and/or vision cameras 104 to detect that the target vehicle 306 is making a right turn or left turn out of the zone 304. In the scenario depicted in FIG. 4, the target vehicle 306 turns and leave the zone 304 laterally without moving forward out of the zone 304. In exemplary embodiments, if the target vehicle 306 moves more than three meters sideways, it is considered as having departed the zone 304. In this example, the lateral position and speed of the target vehicle 306 are used to determine when to issue an alert 108.

Similar to the processing described above in reference to FIG. 3, if the go-notifier algorithm 102 does not detect that the host vehicle 302 is moving within the amount of time specified by the stationary threshold, then an alert 108 is generated to notify the driver of the host vehicle 302 that it may be time to move the host vehicle 302 forward. As described previously, the notification may take the form of one or more visual, aural and/or haptic notifications directed to the driver of the host vehicle 302. In reference to FIG. 4, when the host vehicle 302 is stationary, the target vehicle 306 is moving at a pre-defined minimum speed (e.g., 1 kilometer per hour, 5 kilometers per hour) and the target vehicle 306' 306" starts to move out of the zone 304, then an alert 102 is generated.

Figure 5:
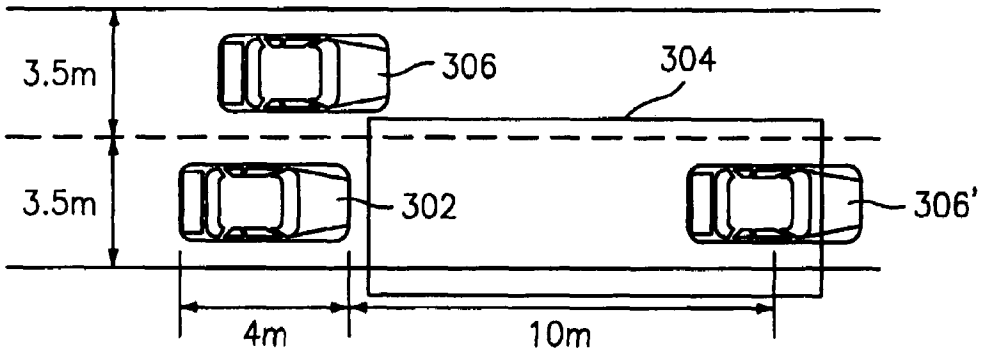
FIG. 5 is a diagram of a fly-by scenario that may be implemented by exemplary embodiments.

FIG. 5 is a diagram of a fly-by scenario that may be implemented by exemplary embodiments to help prevent false alerts to the operator of the host vehicle 302. The scenario depicted in FIG. 5 results when the target vehicle 306 passes the host vehicle 302, and is in the zone 304 for a short period of time. The target vehicle 306' moves out of the zone 304 after passing the host vehicle 302. This scenario will not generate an alert 108 because the target vehicle 306' will not be in the zone 304 for more than the time specified by the time in zone threshold. Alternatively, or additionally, this scenario will not generate an alert 108 if the host vehicle 302 is moving because the go-notifier algorithm 102 requires the host vehicle 302 to be stationary for at least the amount of time specified by the host vehicle stationary threshold before issuing an alert 108.

Figure 6:
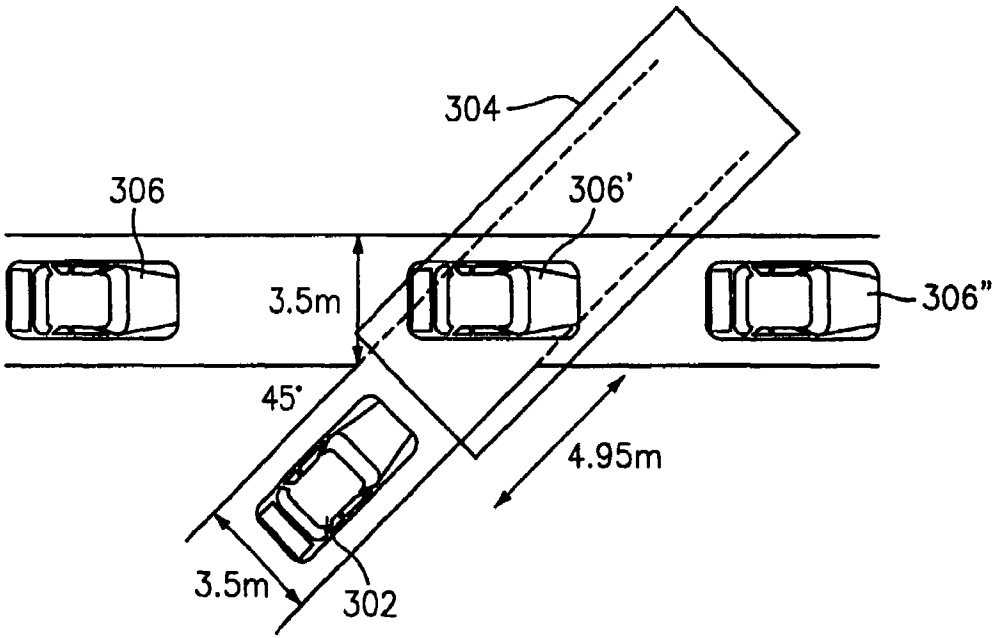
FIG. 6 is a diagram of a diagonal crossing scenario that may be implemented by exemplary embodiments.

FIG. 6 is a diagram of a diagonal crossing scenario that may be implemented by exemplary embodiments to help prevent false alerts to the operator of the host vehicle 302. The scenario depicted in FIG. 6 results when the target vehicle 306 is part of a traffic stream on a road that is different than the road occupied by the host vehicle 302. The target vehicle 306' is in the zone 304 for a short period of time while moving past the host vehicle 302. The target vehicle 306" moves out of the zone 304 after crossing the path (laterally or diagonally) of the host vehicle 302. This scenario will not generate an alert because the target vehicle 306' will not be in the zone 304 for more than the amount of time specified by the time in zone threshold.

Forward and traverse movements of the target vehicle 306 are detected by comparing the forward speed with the lateral speed. In exemplary embodiments, if the ratio of the forward to lateral speed is less than one, it is assumed that the target vehicle 306 is moving more or less sideways without moving forward, which is a case of a no-alert situation. All of these are based on the assumption that the target vehicle 306 movement is a legitimate one only if the target vehicle 306 moves forward more than sideways, at least in the beginning. In other words, under all circumstances, the target vehicle 306 will move forward first and then maybe turn sideways. An exception may happen when the target vehicle 306 is the first vehicle at an intersection and has turned a bit, but stopped at some sharp angle (for example, about 45 degrees to the right at an intersection, similar to the target vehicle 306' in FIG. 4) due to the on-coming transverse traffic. In this case, the ratio of the forward to sideway speed would be less than one, and hence in exemplary embodiments a go-notifier alert will not be issued.

Alternate exemplary embodiments provide cooperative sensing by interacting with road infrastructure or other vehicles. Along with data from the sensor(s) 106, the go-notifier algorithm 102 on the host vehicle 302 also receives data from a road infrastructure device (e.g., a traffic light indicating that it has turned green). In alternate exemplary embodiments, a preceding vehicle informs the road infrastructure system via some sort of communication protocol of its movements. The road infrastructure collects such information from many vehicles in the vicinity, analyzes it, and makes a decision regarding traffic flow, etc. and then communicates the resulting data to the host vehicle 302. This setup would be useful when the preceding vehicle crosses an intersection, but stops due to a traffic jam. The host vehicle 302 then should not start crossing the intersection because if the host vehicle 302 fails to complete the crossing and gets stuck in the middle of the intersection, it will impede the transverse traffic. The data from the road infrastructure may be received, for example via a wireless receiver on the host vehicle 302. In addition, the go-notifier algorithm 102 may receive data from the target vehicle 306 indicating the target vehicle 306 intentions and/or behavior. Again, the data may be received via a wireless receiver on the host vehicle 302.

Exemplary embodiments may be utilized to remind the operator of a vehicle to move the vehicle forward immediately or shortly after a traffic light has changed or a traffic jam has been cleared. Exemplary embodiments utilize any existing sensors, vision cameras and/or human machine interfaces (dashboard, microphone) already located on the vehicle for detecting traffic movement and for alerting the operator of the vehicle that it is time to move the vehicle forward. In addition, exemplary embodiments minimize false alerts by not generating alerts when a target vehicle 306 is a fly-by vehicle or when a target vehicle 306 is traveling in a traverse direction to the host vehicle. Exemplary embodiments provide a cost effective manner of keeping traffic flowing and may result in less traffic congestion.

As described above, the embodiments of the invention may be embodied in the form of hardware, software, firmware, or any processes and/or apparatuses for practicing the embodiments. Embodiments of the invention may also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A method for alerting a vehicle operator to traffic movement, the method comprising:

identifying a zone around a host vehicle;

identifying a target vehicle in the zone;

monitoring speed and location of the target vehicle; and generating an alert in the host vehicle if the target vehicle is moving outside of the zone at a speed higher than a minimum speed and the host vehicle is stationary.

2. The method of claim 1 wherein the alert is generated if the target vehicle is moving outside of the zone at the minimum speed and the host vehicle has been stationary for longer than a host vehicle stationary threshold.

3. The method of claim 1 wherein the alert is generated if the target vehicle is moving outside of the zone at the minimum speed and the target vehicle has been in the zone for longer than a time in zone threshold.

4. The method of claim 1 wherein the alert is generated if the target vehicle is moving outside of the zone at the minimum speed, the host vehicle has been stationary for longer than a host vehicle stationary threshold, and the target vehicle has been in the zone for longer than a time in zone threshold.

5. The method of claim 1 wherein the alert is not generated if the target vehicle is moving in a traverse direction relative to the host vehicle.

6. The method of claim 1 wherein the zone is located in front of the host vehicle.

7. The method of claim 6 wherein the zone is rectangular in shape.

8. The method of claim 7 wherein the rectangular shape is about ten meters long by about three meters wide.

9. The method of claim 1 wherein the target vehicle moves outside of the zone by moving forward.

10. The method of claim 1 wherein the target vehicle moves outside of the zone by turning right or left.

11. The method of claim 1 wherein the alert is utilized to create one or more visual, aural and haptic notifications to an operator in the host vehicle.

12. The method of claim 1 wherein the zone varies based on one or more of a roadway condition, a traffic/weather condition, and an operator of the host vehicle.

13. The method of claim 1 further comprising receiving data from a road infrastructure device for use in determining whether to generate the alert.

14. A system for alerting a vehicle operator to traffic movement, the system comprising:

an object detection device; and a processor in communication with the object detection device, the processor including instructions for facilitating:

identifying a zone around a host vehicle;

identifying a target vehicle in the zone using input from the object detection device;

monitoring speed and location of the target vehicle using input from the object detection device; and generating an alert in the host vehicle if the target vehicle is moving outside of the zone at a speed higher than a minimum speed and the host vehicle is stationary.

15. The system of claim 14, wherein the object detection device includes one or more of a sensor and a vision camera.

16. The system of claim 14 wherein the alert is generated if the target vehicle is moving outside of the zone at the minimum speed and the host vehicle has been stationary for longer than a host vehicle stationary threshold.

17. The system of claim 14 wherein the alert is generated if the target vehicle is moving outside of the zone at the minimum speed and the target vehicle has been in the zone for longer than a time in zone threshold.

18. The system of claim 14 wherein the alert is generated if the target vehicle is moving outside of the zone at the minimum speed, the host vehicle has been stationary for longer than a host vehicle stationary threshold, and the target vehicle has been in the zone for longer than a time in zone threshold.

19. The system of claim 14 wherein the alert is not generated if the target vehicle is moving in a traverse direction relative to the host vehicle.

20. A computer readable storage medium storing a program for execution by a processing circuit, the program causing the processing circuit to perform a method, the method comprising:

identifying a zone around a host vehicle;

identifying a target vehicle in the zone;

monitoring speed and location of the target vehicle; and generating an alert in the host vehicle if the target vehicle is moving outside of the zone at a speed higher than a minimum speed and the host vehicle is stationary.

* * * * *